United States Patent [19]

Koppers et al.

[11] Patent Number: 4,887,935

[45] Date of Patent: Dec. 19, 1989

[54] METHOD OF CONTROLLING THE MOVEMENT OF A LONGWALL EXCAVATION FRONT, ESPECIALLY THE FACE OR BREAST OF A COAL SEAM

[75] Inventors: Manfred Koppers, Duisburg; Lotar Sebastian, Bochum; Kuno Guse, Witten-Bommern, all of Fed. Rep. of Germany

[73] Assignee: Bochumer Eisenhutte Heintzmann GmbH & Co. KG, Bochum, Fed. Rep. of Germany

[21] Appl. No.: 288,408

[22] Filed: Dec. 21, 1988

[30] Foreign Application Priority Data

Dec. 23, 1987 [DE] Fed. Rep. of Germany ..... 3743758

[51] Int. Cl.[4] ..... E21C 35/08; E21D 23/00; E21D 15/44

[52] U.S. Cl. ..... 405/302; 299/1; 405/291

[58] Field of Search ..... 405/302, 291–296; 299/1, 31, 33; 91/170 MP

[56] References Cited

U.S. PATENT DOCUMENTS

| | | | |
|---|---|---|---|
| 4,048,804 | 9/1977 | Elsner et al. | 61/451 D |
| 4,099,781 | 7/1978 | Sawayama et al. | 299/1 |
| 4,134,270 | 1/1979 | Small et al. | 405/302 |
| 4,146,271 | 3/1979 | Ward et al. | 299/1 |
| 4,228,508 | 10/1980 | Benthaus | 299/1 X |
| 4,708,394 | 11/1987 | Trox et al. | 405/302 X |

FOREIGN PATENT DOCUMENTS

| | | |
|---|---|---|
| 1533720 | 1/1970 | Fed. Rep. of Germany . |
| 2700798 | 7/1977 | Fed. Rep. of Germany . |
| 2806982 | 8/1979 | Fed. Rep. of Germany . |
| 3111875 | 10/1982 | Fed. Rep. of Germany . |
| 1148953 | 4/1969 | United Kingdom . |

*Primary Examiner*—Dennis L. Taylor
*Attorney, Agent, or Firm*—Herbert Dubno

[57] ABSTRACT

The advance of a mining front in longwall mining is effected by a process in which sensors measure the displacement of displacement cylinders coupling the linked prop elements to the linked conveyor elements with their respective cutters. A computer generates a baseline represented by the actual prop line as a starting point and the conveyor elements and cutters are then advanced all along the mining front via the displacement cylinders. The sensors input the respective displacements into the computer so that an actual conveyor line is determined in the computer and serves as the baseline for after-drawing of the prop elements via the cylinders. The new prop line calculated by the computer then forms the baseline for further advance and the advance can be controlled to ultimately align the conveyor elements along the conveyor line corresponding to a setpoint line defined by the computer and parallel to the original baseline.

14 Claims, 3 Drawing Sheets

METHOD OF CONTROLLING THE MOVEMENT OF A LONGWALL EXCAVATION FRONT, ESPECIALLY THE FACE OR BREAST OF A COAL SEAM

FIELD OF THE INVENTION

Our present invention relates to a method of controlling the advance of an excavating front of a seam in the longwall mining of, for example, coal, wherein a multiplicity of conveyor elements can be disposed along the wall, the mineral is excavated along the seam face into a continuous conveyor formed by the conveyor elements, and the conveyor displaces the mined material to one end of the conveyor, i.e. to a tunnel through which the mined coal is carried away.

BACKGROUND OF THE INVENTION

In longwall mining, the breast or face of a coal seam, for example, can be mined by displacing along the breast of the seam, a row of conveyor elements which can be linked together and can be provided with a cutter, e.g. a coal plow (see U.S. Pat. No. 4,048,804, for example) to excavate the coal into the conveyor.

The conveyor generally comprises flights joined together by an endless chain and movable along a trough to carry the mined material to a tunnel or drift formed along a side of the path of the mining apparatus and thus along the coal seam to be excavated so that the coal can be brought out of the mine.

The mining machine can comprise a prop connected to each of the conveyor elements or segments by a displacement cylinder and can have one or more rams adapted to press a cap against a roof of the chamber in which mining is effected and usually overhanging the conveyor.

Behind the machine in the goaf, the roof can be permitted to collapse. The advance of the machine is effected in a stepwise manner with the displacement cylinders being actuated to advance the conveyor elements, the cutter and the mining front into the breast of the coal seam with the props braced between the roof and floor and then, by contraction of the displacement cylinders or retraction of the rods of these cylinders, with the ram pressure relieved, the props are drawn forwardly behind the conveyor segments.

The control of the movement of the assemblies defining the excavation front is important in mining, because the geological formations are generally not homogeneous so that it is not possible to advance the cutting front and the respective conveyor elements at the same rate in a perfectly straight line perpendicular to the advance direction against the breast of the longwall of the seam which is to be excavated and to successfully maintain the advance with the lines of conveyor elements always parallel to one another and straight.

The control of the props has generally been effected by individual controls for the various props utilizing one of a number of standard control techniques. The control systems which have been used include individual control, sequencing control, group sequence control and central control.

Of these control techniques, central control is the most automated. It is known to provide this type of control to establish a line for the props which corresponds to a setpoint line for the excavation with respect to which deviations are determined which can arise because of the differences in the hardness of the minerals to be excavated by the respective assemblies along the mining front.

In the past and in practice, the detected deviations were corrected by manual control of the advance of the respective assemblies in a time-consuming and labor-intensive manner.

German patent document No. 15 33 720 describes a process for controlling the excavation front in which the prop structures disposed within a mine tunnel and arrayed next to one another along a longwall face are associated with guides individually or for each group of props. Each of the prop structures can have a measuring device for detecting the number of steps and the respective step widths. The measurement data are supplied to a central computer which determines the difference between the step widths between the guide prop structures and the usual prop structures, compares these differences with a threshold value and upon exceeding of the threshold, commands a signal for actuating the displacement cylinder or for corresponding control of the excavating device.

A drawback of this process is that it requires intervention in control since the guide prop structure does not have any displacement measuring device and thus cannot be provided in a feedback path for control. Position measurements are derived from displacement differences between the advanced prop and the guide and it is thus difficult, if not impossible, to ensure excavation, corresponding to predetermined setpoint lines.

Problems in the region of the guide prop structures, whether resulting from displacement of the conveyor or by the drawing of the props after them, cannot be taken into consideration in this process and can result in an adverse effect on the entire mining process over the whole mining front. It is especially necessary to have manual intervention when it is necessary to swing the excavation front and it is frequently necessary in these cases to interrupt the mining which is uneconomical.

When a system is provided which operates purely with actual value-position detection, passive influences on the control system can be observed, i.e. the point in time or state at which a control action must be taken, may not depend upon actual effects, but rather on phenomena that are a consequence of relatively passive elements because of the need to exceed certain thresholds or the like. Thus the history of a particular state plays a significant role and excessive deviations may not be sufficiently corrected and can pyramid into problem conditions. In conventional systems for controlling the movement and deviation of the mining front, therefore, local deviations may have to be permitted and can develop into problems.

OBJECTS OF THE INVENTION

It is, therefore, the principal object of the present invention to provide a method of controlling the mining front in longwall mining, whereby these drawbacks are avoided.

Another object of this invention is to provide a method of operating the longwall mining apparatus of the aforedescribed type, whereby manual intervention can be eliminated and the drawbacks of the earlier systems as described can be avoided as well.

It is also an object of our invention to provide an improved method of operating a longwall mining apparatus in which setpoint mining lines can be maintained with great precision and without the buildup of large errors or the requirement for interruption of mining operations for error correction.

SUMMARY OF THE INVENTION

These objects and others which become apparent hereinafter are attained, in accordance with the present invention in a method of controlling the advance of an mining front in longwall mining wherein a roof support is subdivided to form a row of props with respective fluid-operated prop rams and with respective excavator assemblies disposed along the mining front, each assembly comprises a conveyor element linked to the other elements of the chain to form a continuous conveyor displacing mined material along the front and a cutter element excavating the material from the sea face into the conveyor, each conveyor element being connected to the respective prop by a respective fluid-operated displacement cylinder, the displacement cylinders and at least the rams of the props are controlled by a central control computer, and sensors are provided to detect movements of the props and conveyor elements and are connected to the computer.

The method comprises the steps of:

(a) automatically determining at the computer, during mining of the material from the seam face and displacement of the mined material along the conveyor, cyclically an actual location and contour of a conveyor line ($F_1$, $F_2$, $F_3$) of at least some of the conveyor elements corresponding to actual positions thereof;

(b) automatically determining at the computer an actual location and contour of a prop line ($A_1$, $A_2$) of at least some of the props corresponding to actual positions thereof;

(c) establishing a baseline at the computer utilizing the conveyor line and the prop line; and (d) automatically advancing at least some of the conveyor elements and drawing at least some of the props after the conveyor elements under the control of the computer using the baseline as a reference for the advance of the conveyor elements and the drawing of the props.

When we refer to the establishment of a baseline at the computer utilizing the aforementioned conveyor line and prop line, we mean to make clear that we can use both the conveyor line and the prop line as the baseline for further advance of the conveyor elements and after drawing of the props by the displacement cylinder, or that we can use the prop line and the conveyor line alternately as the baselines, or that we can use a combination of the prop line and the conveyor line as the baseline. Stated otherwise, the conveyor line and the prop line collectively and/or alternately, are at least in part utilized to define the baseline or reference line for the future advance of the conveyor and the drawing of the props after the conveyor.

According to a feature of the invention the advance of at least some of the conveyor elements and the drawing of at least some of the props after the conveyor elements under the control of the computer using the baseline is effected to predetermined setpoint lines preprogrammed into the computer.

Furthermore the props and the conveyor elements with at least partially contracted respective displacement cylinders are oriented along respective prop and conveyor lines forming respective baselines ($A_1$, $F_1$) and coordinates of the baselines are stored in the computer.

Advantageously the conveyor elements are advanced by the respective displacement cylinders relative to the respective props stepwise with defined cutting-depth setpoint values during an mining of the structure until a stroke of at least one displacement cylinder is equal to a maximum stroke or until a predetermined stroke difference between displacement cylinders is reached and thereupon coordinates of the actual conveyor line ($F_2$), relative to the prop line ($A_1$) serving as the baseline and corresponding to the actual stroke magnitudes detected by the sensors and fed to the computer, are stored.

In the case in which setpoint lines are preprogrammed in the computer, the actual conveyor line ($F_2$) corresponding to a predetermined setpoint conveyor line ($F_3$) determined by the computer is corrected by at least partial advance of respective conveyor elements and mining of the structure with defined cutting-depth setpoint values to bring the actual conveyor line to the setpoint conveyor line, and coordinates of the actual conveyor line coinciding with the setpoint conveyor line are then stored in the computer as coordinates of a new baseline.

In this case the props are drawn by the displacement cylinders along the actual conveyor line coinciding with the setpoint conveyor line ($F_3$) and constituting the new baseline, the displacements of the props by which they are drawn with the displacement cylinders are detected by respective sensors and transmitted to the computer, and coordinates of the actual prop line are then stored in the computer as coordinates of a further new baseline.

The baseline for a subsequent drawing of the props after the conveyor element can be constituted by a line parallel to the actual conveyor line.

According to another feature of the invention, sensors of displacement of the displacement cylinders feed values of movement of the props to the computer to supply the computer with coordinates of the actual prop line which are stored in the computer to define a new baseline.

For partial mining along the mining breast, the actual positions of some of the conveyor elements are corrected by advancing them with defined cutting-depth setpoint values to bring them to the setpoint conveyor line, and actual-value coordinates of the conveyor elements coinciding with the setpoint conveyor line are then stored in the computer as coordinates of a new baseline.

After drawing of the props toward the conveyor elements by the respective displacement cylinders, a difference can be formed between a setpoint stroke determined by the computer and the respective actual stroke value, and the respective conveyor element can then be advanced by a stroke reduced by the maximum value of this difference.

Alternatively or in addition, difference values are determined between setpoint strokes of the displacement cylinders as determined by the computer and respective actual stroke values. Upon repetition of a predetermined magnitude of these difference values for a respective displacement cylinder, a signal is triggered at the respective prop corresponding to this displacement cylinder.

The invention has been found to provide a simple and precise steering of the mining front. Since each displacement cylinder comprises a sensor for detection of the relative movement between the conveyor element and the respective prop member, it is possible to always generate an actual reference or baseline corresponding to the actual line of the conveyor, i.e. the conveyor line or the actual line of the props or prop line so that deviations from a given prop line can be determined and automatically corrected or compensated directly and immediately.

The computer reference line or baseline is so selected upon advance of the conveyor and after drawing of the props that the relative movement between props and conveyor can be transformed into absolute coordinates so that within the computer the actual positions of the conveyor and the props can always be known and corrected as may be required.

The advantage of preprogramming the computer with given setpoint lines is that this provides a defined mining pattern. The setpoint inputs can be fed to the computer in absolute coordinates corresponding to the pattern of the geological stratum which is to be excavated. In this fashion it is possible to provide setpoint lines and mining fronts which are not only linear but can have any front contour as desired. It has been found to be especially effective to provide an mining front which is convex in the direction of the longwall breast as seen from above. With corresponding setpoint line values, we can define conveyor curvatures with great variety and can hold these curvatures during mining so that, for example, as seen in a plan view, both step-shaped or loop-shaped mining fronts can be provided.

The invention ensures that impermissibly high deviations in the line of the excavating front will be limited because each advance utilizes as a baseline, a prior line of the conveyor elements and/or props. This ensures that overloading of the conveyor can be prevented and allows the computer to establish a maximum angular offset between conveyor elements along the excavation front, thereby preventing the development of excessively sharply angled portions of the excavating front or line. The angle can be calculated by forming difference values between the strokes of the displacement cylinders of neighboring assemblies as a function of the respective known or starting positions of the excavating assemblies.

According to a feature of the invention, the baseline is switched alternately between the conveyor line and the prop line and serves as the starting point for each advance. It is possible that this alternation of the baseline from conveyor line to prop line, to precisely determine the absolute coordinates of the actual prop line and a conveyor line in the computer to compare these absolute coordinates with a predetermined and stored setpoint line and effect a correction or compensation based upon the differences between these coordinates and coordinates of the setpoint line, thereby ensuring a defined path of the mining and configuration or steering of the mining front.

The actual conveyor line can then be adjusted to the predetermined setpoint conveyor line after each mining step and, advantageously, before the props are drawn forwardly to follow the advance of the conveyor elements.

The threshold value or control device at which the correction becomes effective can be selected to be practically as small as is desirable so that detrimentally large deviations from the predetermined mining line can never occur in the mining front in the first place.

The maximum possible control deviation in this process can be in the range of the stroke length of a displacement cylinder. This stroke length deviation develops at the latest after a complete advance of one of the displacement cylinders in, for example, local or regional mining along a limited portion of the longwall and is the basis for a correction of the position of the mining front corresponding to the setpoint position.

This extreme case in which the control deviation corresponds to a stroke length of a displacement cylinder, can only arise when one of the mining assemblies has been fully advanced in the region of another mining assembly whose displacement cylinder has not advanced. This condition is purely theoretical since it practically never arises that in one section of the mining front, one of the assemblies will not be advanced for mining under proper control.

In the discussion below it will be apparent that the control deviation can be set at the computer, for example, by inputting a maximum permissible stroke deviation between two displacement cylinders and/or between neighboring displacement cylinders. These inputs can be summed over a multiplicity of such strokes or advances or for each stroke increment.

By detecting the stroke step differences, it is possible to set not only permissible deviations of the mining front from a predetermined mining line, but also a maximum angular offset of adjoining lengths or sections of the conveyor.

Upon the after-drawing of the props in the successive step of the method, the advance of the prop members can be detected via the sensors and transmitted to the computer which thus can generate within the computer, the actual prop line and establish it as the reference line or baseline for the next excavating advance.

The method of the invention can be used to generate any desired preprogrammed steering of the mining front. The correction of the conveyor line can be effected in every second operating step or cycle, i.e. after the prop line has been advanced or the respective props have been drawn after the conveyor elements or members. This has the advantage that the corrections for steering the mining front upon after-drawing of the prop members and for advance of the conveyor members is effected only as the advance of the mining front is effected by the strokes of the displacement cylinders. In this manner a high mining efficiency can be achieved. The required corrections of the steering of the mining front can be effected simultaneously with the after drawing of the prop elements or advance of the conveyor elements.

Problems can be avoided when the mining front in each case is brought exactly to a predetermined mining line and the tendency toward any deviation therefrom is monitored so that there is no need for a massive or expensive correction of the respective lines to the setpoint line.

We can operate, therefore, without interruption of the process with any sequence of the prop and conveyor lines as the base line for the next advance and as a match to respective setpoint lines.

According to a further feature of the invention, as mentioned briefly above, upon the after-drawing of the prop elements, the difference is determined between the predetermined and instantaneous forward steps of each displacement cylinder and the conveyor is advanced together with the excavating device by a displacement reduced by the maximum stroke-difference thus ascertained. In this manner, we can ensure that the displacement cylinders of the assemblies closer to the mining front will only be advanced sufficiently so that the assemblies furthest from the mining front can overtake the difference in proximity to the mining front and thereby compensate for the error in advance.

This avoids local jumps ahead by some of the assemblies along the mining front since such jumps ahead can only be cured with difficulty and in a time-consuming manner.

In practice, small barriers which may interfere with a complete after-drawing of individual prop elements have little if any influence on the mining front. This type of control has been found to be particularly advantageous since such disturbances to the after-drawing of a prop element usually are self-curing and the subsequent after-drawing can be compensatory.

To ensure that an embodiment to the advance of a single prop element will not hinder the advance of the entire mining front, a measurement difference is stored automatically and when the same prop element repeatedly does not reach the predetermined setpoint value, a single step is generated by the computer so that this ineffectively operating prop element can be rapidly ascertained and the defect corrected.

The process of the invention provides for steering control of the mining front in a more highly or automated manner than prior art methods, with greater precision and with greater availability of information enabling the operator to appreciate the particular state of the mining process. It also allows greater efficiency of mining, higher outputs and reduced need for personnel per unit output. Mining economy is thus greatly improved.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 3:
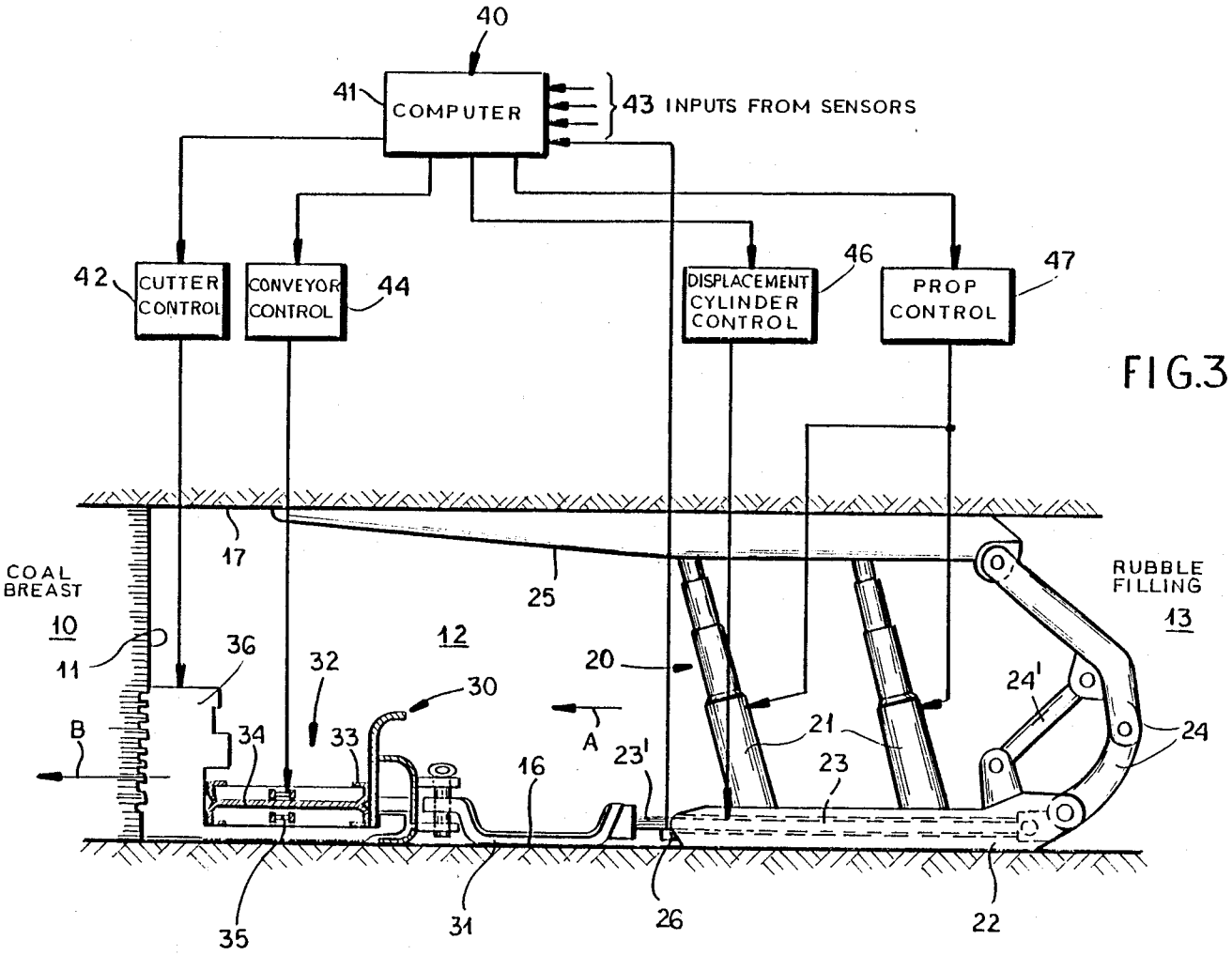
FIG. 3 is a highly diagrammatic side elevational and sectional view showing the mining of a longwall face but only one unit of the excavating apparatus, namely a single prop element of the prop system, a single conveyor element of the conveyor chain and a single excavator plow associated with that conveyor.

Referring first to FIG. 3, it can be seen that a coal seam 10, has a longwall face or breast 11 to be mined as shown in cross section by an excavating apparatus.

The apparatus can comprise a prop arrangement 20 of which only a single prop element has been shown (see U.S. Pat. No. 4,048,804), it being understood that such prop elements are provided in a perpendicular to the plane of the paper in FIG. 3 and parallel to the longwall (see especially German patent document No. 27 00 798).

The chamber 12 formed by the excavation has a floor 16 and a roof 17. Behind the advance of the longwall mining apparatus, the goaf 13 can be filled with rubble left by collapse of the roof.

The mining apparatus also comprises a coal plow 36 riding along the conveyor formed by a row of conveyor elements which can be linked together as is conventional in the art to define the mining front (see German patent documents Nos. 15 33 720, 27 00 798 and 31 11 875). The apparatus is provided with a control system generally represented at 40.

While FIG. 3 is highly diagrammatic and should not be viewed as illustrating the specific structure which may be used for the purpose, it will be apparent that each prop element of the walking prop arrangement 20 can comprise a hydraulic piston-and-cylinder arrangement 21 which can be carried by a skid 22 adapted to be advanced along the floor 16 of the tunnel by a displacement cylinder 23 which draws the prop element behind the conveyor assembly 30 to which the prop element is coupled. The rod of cylinder 23 is shown at 23'.

The prop element also includes a cap 25 which can overhang the excavating part of the machine as is conventional with such props.

It will be apparent that when the rams 21 are extended, the individual prop is braced against the roof and the floor and the cylinder 23 can be pressurized to extend its piston rod to advance the assembly 30 to the left (arrow B).

The cap 25 is articulated by the goaf shields 24 and a link 24' to the skid 22 (see U.S. Pat. No. 4,048,804, U.K. patent No. 1,149,953 and German patent document No. 28 06 982).

Conversely, when rams 21 are retracted, the cylinder 23 can be energized to retract its piston and thereby draw the prop to the left as represented by the arrow A in the after-drawing step previously mentioned.

The assembly 30 basically comprises a skid 31 which also rides on the floor 16. A conveyor element 32 is likewise provided and comprises a trough 33 and flights 34 linked by a chain 35. The conveyor has also been shown highly diagrammatically and serves to represent any segmented conveyor which can conform to the mining front and can have trough segments linked or articulated together and traversed by a conveyor chain as previously described. The conveyor serves to collect the excavated product and displace it along the mining front to at least one end of the mining front at which the excavated product can be carried rearwardly through a tunnel flanking the coal seam which is excavated by the longwall method.

The cutter arrangement can, if desired, be flights of the conveyor which run along the leading edge thereof. Some other arrangement can be used, such as drums or the like, which are provided with picks or other tools for breaking away the mined material from the wall to be excavated. For simplicity of illustration, however, in the embodiment shown, a plow 36 is provided as described in U.S. Pat. No. 4,048,804. Operation of the cutter will cause the excavated mineral to fall into the conveyor segment trough 33 and carried away in the manner described.

The control system for the apparatus has been shown at 40 and can comprise a computer 41 which can be preprogrammed for the various setpoint lines mentioned earlier and has appropriate memories for such data and a processor for receiving inputs from the sensors 26 of the displacement cylinders 23. The fact that a plurality of such inputs are provided, i.e. inputs from each of the assemblies of the chain of such assemblies, is represented by the arrows 43.

The computer has an output to a cutter controller 42 which controls the drive of the cutter 36, an output to a conveyor controller 44 which controls the advance of the conveyor chain, an output to the hydraulic controller 46 of the displacement cylinder 23 regulating the advance of the conveyor elements and the after-drawing of the prop elements, and an output to the prop hydraulic controller 47.

Before beginning an mining interval (see FIGS. 1A–1G and 2A–2D), in the usual manner, a plurality of assemblies of the type shown in FIG. 3, linked together in a row, are positioned along the front to be excavated, i.e. along the longwall breast 11.

Initially the prop line is, as a rule, a straight line located somewhat rearwardly from the mining front and can constitute a predetermined baseline from which the mining is started. However, the prop line need not be a straight line and can have any desired configuration, for example, corresponding to the contour of the longwall to be mined.

Such a baseline represented in the drawing has a heavy line with the index $A_1$.

In the embodiment of FIGS. 1A–1G and in the embodiment of FIGS. 2A–2D, fifteen props and respective conveyor elements have been represented by their paths shown as vertical arrows and in equispaced relationship along the baseline $A_1$ which is linear as shown in these Figures.

Each prop element is connected in the described manner via a displacement cylinder with a conveyor element or segment which is linked to the other segments to form a continuous conveyor. On the side turned toward the mining front, each conveyor segment is provided with an excavating device or cutter, also in the manner described.

The displacement cylinder is formed basically as a linear amplifier and can be positioned in response to the central computer with a position precision of the order of tenths of a millimeter. Its position is hydraulically extended or retracted as detected by the sensors 26.

The hydraulic systems, including the respective valves, are incorporated in the displacement cylinder hydraulics which are electrically operated by an output from the central computer 40. Each displacement cylinder has sensor means such as has been described at 26 for detecting the stroke position. The output signals of these sensors are also fed to the central computer.

As has been described also previously, the ram 21 of the prop and the drive of the excavator are also controlled by the computer.

Figure 1G:
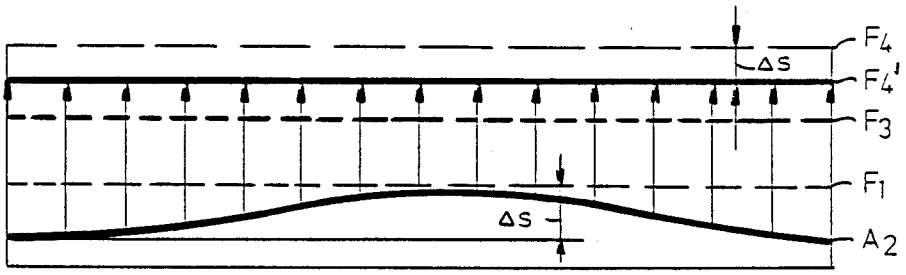
FIG. 1A–1G illustrates steps in the process of the invention.
Figure 1F:
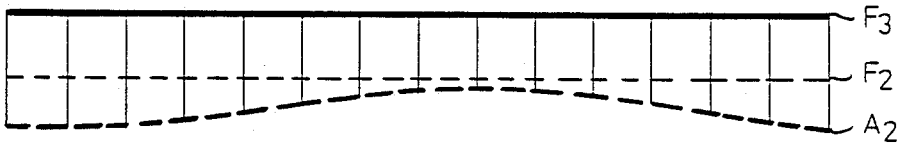
Figure 1E:
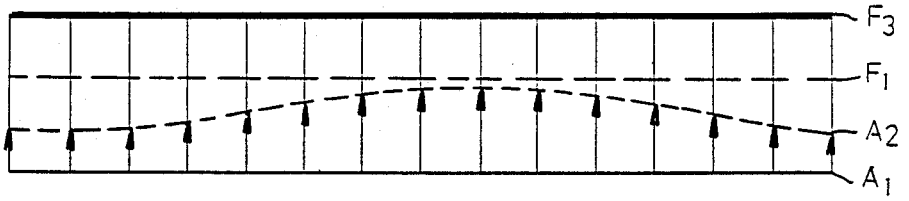
Figure 1D:
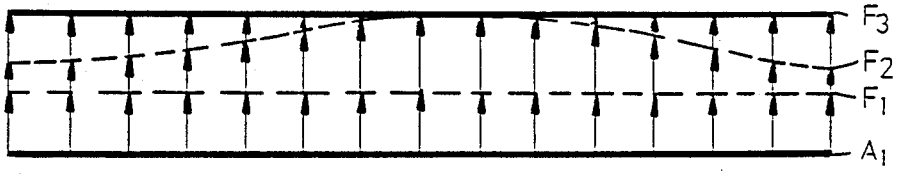
Figure 1C:
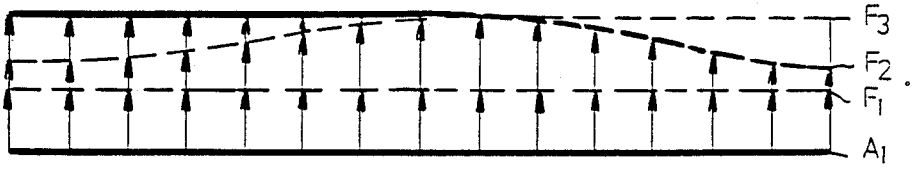
Figure 1B:
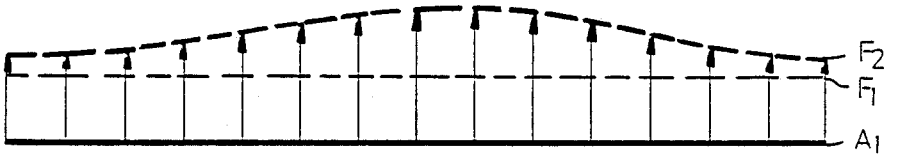
Figure 1A:
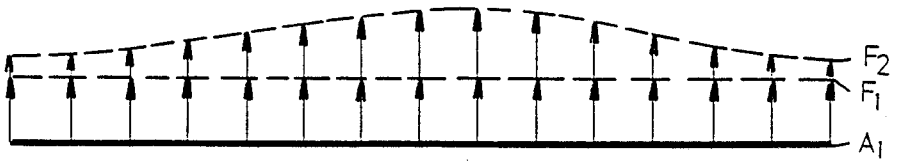

Starting from the initial position which has been illustrated in FIG. 1A, the coordinates of the baseline $A_1$ (actual prop line) and $X_1$ (actual conveyor line) are stored in the computer 40. In this case, the prop line $A_1$ serves initially as the baseline or reference line for the following mining operation.

The conveyor is then advanced by the stepwise advance of the displacement cylinders with defined cutting depth setpoint parameters which may have previously been stored in the computer and corresponding to the stepwise advance of the mining operation until the stroke of at least one of the displacement cylinders has reached its maximum or until a previously defined or predetermined stroke difference between two displacement cylinders is reached.

Via the sensors, the computer 40 is continuously fed with data representing the actual stroke positions of all of the displacement cylinders so that the computer 40 can thus form at all times, the actual conveyor line therein.

Since the prop line is fixed and the coordinates of the prop line are known, the computer can readily calculate the coordinates of the actual conveyor line by addition of the strokes or displacements of the displacement cylinders to the reference or baseline $A_1$ coordinates.

FIG. 1B shows the position in which the stroke of at least one of the displacement cylinders has been exceeded or a predetermined difference between two displacement cylinders has been reached. At this point in time, the actual conveyor line $F_2$ determined by the computer from the inputs from the sensors is compared with the setpoint conveyor line $F_3$ which is parallel to the baseline $A_1$.

Corresponding to the detected differences between the actual conveyor line $F_2$ and the setpoint conveyor line $F_3$, the further mining is effected by local minings as is represented in FIGS. 1C and 1D until, in the latter Figure, the actual conveyor line coincides with the setpoint conveyor line $F_3$.

The coordinates of this setpoint conveyor line $F_3$ and the actual conveyor line corresponding thereto are then stored in the computer and serve as the reference line or baseline for the subsequent after-drawing of the prop elements.

Along the new reference line $F_3$, prop elements are displaced by their respective cylinders 23 in the direction of arrow A (FIG. 3) and as represented by the arrows in FIG. 1E.

If there is no obstruction to the after-drawn movement of the prop elements, the prop line can be drawn to the position of the first conveyor line $F_1$. In practice, however, it is found that at least one of the prop elements will be partly obstructed and cannot move the full stroke length of its cylinder. Correspondingly, the sensors will signal the actual displacements to the computer utilizing the present conveyor line $F_3$ as the reference or baseline for the positions of the props along the actual prop line $A_2$.

This actual prop line $A_2$, calculated by the computer with great precision, has its coordinates stored as the new reference or baseline as has been indicated in FIG. 1F. To prevent the maximum stroke of a displacement cylinder from being exceeded during advance of the conveyor elements, before the predetermined setpoint conveyor line is reached, the computer determines for each prop element the difference between the setpoint stroke and the corresponding afterdrawn stroke so that the maximum stroke difference resulting from this calculation can be used to reduce the advance of the conveyor in the following mining step.

In FIG. 1G, the next setpoint conveyor line $F_4$ is illustrated and has its location reduced by the magnitude $\Delta s$ from the distance between the position of the conveyor line $F_1$ and the actual prop line $A_2$ in the calculation by this correction of the new setpoint conveyor line $F_{4'}$.

The process shown in FIGS. 2A–2D also starts with a baseline or reference line $A_1$ formed by the initial orientation of the prop elements and constituting the actual prop line at the start of the operation. The initial conveyor line is represented at $F_1$ and is parallel to the prop line or baseline $A_1$.

The coordinates of the baseline $F_1$ and $A_1$ are stored in the computer and are used as the starting points for the mining operation. For example, the baseline $A_1$ can serve as the reference line for determining, in each case, the location of the actual conveyor lines.

Figure 2D:
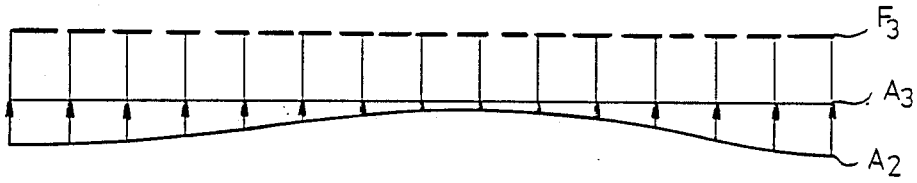
FIGS. 2A–2D illustrate the steps of a variation of the process of the invention.
Figure 2C:
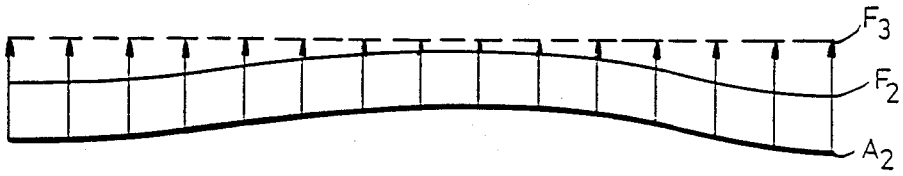
Figure 2B:
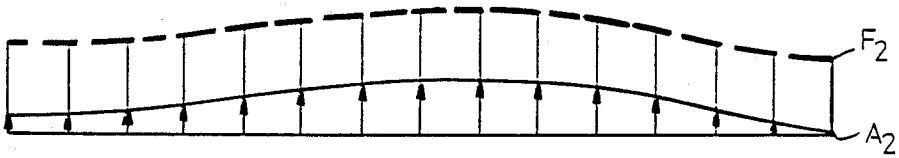
Figure 2A:
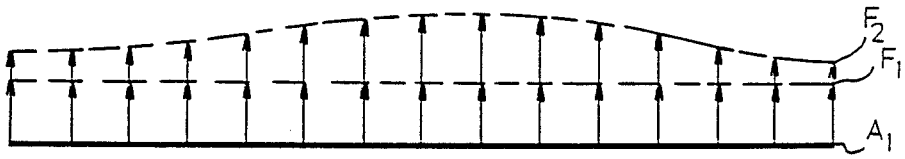

As represented by the arrows in FIG. 2A, the respective assemblies are advanced by the cutting depth setpoint data supplied to the apparatus. Each advance of a respective assembly is effected by a corresponding advance or extension of the respective displacement cylinder.

The stroke changes at the displacement cylinders are transmitted by the respective sensors to the computer which then forms by calculation the actual conveyor line $F_2$ as has been shown in FIG. 2A.

Since the prop line representing the row of props lined up across the tunnel and perpendicular to the direction of advance, remains the aforementioned baseline $A_1$ and the conveyor elements have been advanced corresponding to the mining effected at each such element in the advance of the mining front, the computer records effectively the calculated image of the mining front as is clear from the line $F_2$ in FIG. 2A. This actual conveyor line corresponding to the mining front is no longer linear but has a curvature which in practice corresponds to the mineral hardness of the wall attacked by the excavator.

In FIG. 2A, the advance of the conveyor has been shown to have occurred in a single step. In practice, however, this step will in turn be made up of smaller advances for mining until, of course, at least one of the displacement cylinders has been fully extended and further advance is not possible.

The actual conveyor line $F_2$ then serves as the reference line for after-drawing of the prop elements to the new baseline position $A_2$. In FIGS. 2A and 2B, the respective reference lines have been shown heavy by comparison with the remaining lines. The after-drawing of the individual prop elements is effected over a displacement generated by the computer and controlled as previously described to position the prop elements along the new prop line $A_2$ which is parallel to the conveyor line $F_2$.

The baseline is then switched over again to correspond to the actual prop line $A_2$ as has been shown in FIG. 2C.

In the following mining step, the conveyor elements are advanced as represented by the arrows until the conveyor elements are aligned along a setpoint line $F_3$ determined by the computer and which is parallel to the original baseline $A_1$. In this case as well, the advance of the conveyor elements can be effected during the excavating step until the maximum stroke of a displacement cylinder has been reached or a predetermined stroke difference between two displacement cylinders has been detected.

The position illustrated in FIG. 2D is then achieved and the baseline is now switched over to the new conveyor line $F_3$ which corresponds to the setpoint line. The prop elements are then after-drawn in the manner described to establish the new baseline $A_3$. For the following operation, the baseline $A_3$ will function in the manner of the baseline $A_1$ to which it is parallel, as the new reference line for advance of the cutting front.

The described process thus ensures that following two afterdrawings of the prop elements, the prop line, the conveyor line and the mining front are again parallel to one another and to the original baseline. Of course, the original baseline itself need not be linear but can have a convex, concave or some complex curve form.

In the event a swinging of the mining front is required, it is only necessary within the computer to change the corresponding coordinates of the setpoint line for the corresponding position of the mining front. The displacement cylinders, because they are provided with sensors detecting the actual stroke at all times, not only ensure very high positional accuracy with respect to the reference or baseline at each point, but also permit the orientation of the baseline based upon absolute coordinates as may be desired.

In practice it can be found that the after-drawing of a prop element may be blocked or interfered with so that it can be advanced by only a portion of a predetermined advance which is required for that prop element. To prevent such occurrences from creating problems at the mining front, when the displacement cylinder cannot be retracted to the desired extent, the process represented in FIG. 2 can be provided with a further step at the computer After each advance of the prop elements, the computer an be fed from the individual sensors with signals representing the difference between the computer generated setpoint displacement and the respective actual displacements of the displacement cylinders. The resulting maximum difference is then used as the basis for the maximum advance of the conveyor elements during the next cycle. In other words, the conveyor is not advanced during this next cycle by the maximum stroke of the displacement cylinders, but only by an amount corresponding to this maximum stroke less the maximum difference To prevent the advance of the conveyor line and the prop line from being limited by an individual blocked prop element, the advance differences between the setpoint actual values of the individual prop elements are stored within the computer and compared with the differences at subsequent after-drawing operations. Should the sum of these differences from two successive advances of the prop element exceed a predetermined value, a signal on the defective prop element will be triggered to enable personnel to rapidly find the defective prop element and remove the defect.

We claim:

1. A method of controlling the advance of an mining front in longwall mining wherein a support is subdivided to form a row of props with respective fluid-operated prop rams and with respective excavator assemblies disposed along said mining front, each assembly comprises a conveyor element linked to the other elements of the chain to form a continuous conveyor displacing mined material along said front and a cutter element is provided to mine said material from a seam into said conveyor, each conveyor element being connected to the respective prop by a respective fluid-operated displacement cylinder, the displacement cylinders and at least the rams of the props are controlled by a central control computer, and sensors are provided to detect movements of said props and conveyor elements and are connected to said computer, said method comprising the steps of:

(a) automatically determining at said computer, during mining of said material from said seam and displacement thereof along said conveyor, cyclically an actual location and contour of a conveyor line ($F_1$, $F_2$, $F_3$) of at least some of said conveyor elements corresponding to actual positions thereof;

(b) automatically determining at said computer an actual location and contour of a prop line ($A_1$, $A_2$) of at least some of said props corresponding to actual positions thereof;

(c) establishing a baseline at said computer utilizing said conveyor line and said prop line; and (d) automatically advancing at least some of said conveyor elements and drawing at least some of said props after said conveyor elements under the control of said computer using said baseline as a reference for the advance of said conveyor elements and the drawing of said props.

2. The method defined in claim 1 wherein in step (c) both of said prop and conveyor lines are constituted in common as said baseline.

3. The method defined in claim 2 wherein in step (c) said prop line and said conveyor line are also constituted alternately as said baseline.

4. The method defined in claim 1 wherein in step (c) said prop and conveyor lines are constituted alternately as said baseline.

5. The method defined in claim 1 wherein the advance of at least some of said conveyor elements and the drawing of at least some of said props after said conveyor elements under the control of said computer using said baseline is effected to predetermined setpoint lines preprogrammed into said computer.

6. The method defined in claim 1 wherein the props and the conveyor elements with at least partially contracted respective displacement cylinders are oriented along respective prop and conveyor lines forming respective baselines ($A_1$, $F_1$) and coordinates of said baselines are stored in said computer 7. The method defined in claim 1 wherein said conveyor elements are advanced by the respective displacement cylinders relative to the respective props stepwise with defined cutting-depth setpoint values during an mining of said seam until a stroke of at least one displacement cylinder is equal to a maximum stroke or until a predetermined stroke difference between displacement cylinders is reached and thereupon coordinates of the actual conveyor line ($F_2$), relative to the prop line ($A_1$) serving as the baseline and corresponding to the actual stroke magnitudes detected by said sensors and fed to said computer, are stored.

8. The method defined in claim 5 wherein the actual conveyor line ($F_2$) corresponding to a predetermined setpoint conveyor line ($F_3$) determined by said computer is corrected by at least partial advance of respective conveyor elements and mining of said seam with defined cutting-depth setpoint values to bring the actual conveyor line to the setpoint conveyor line, and coordinates of the actual conveyor line coinciding with the setpoint conveyor line are then stored in said computer as coordinates of a new baseline.

9. The method defined in claim 8 wherein said props are drawn by said displacement cylinders along said actual conveyor line coinciding with the setpoint conveyor line ($F_3$) and constituting said new baseline, the displacements of said props by which they are drawn with said displacement cylinders are detected by respective sensors and transmitted to said computer, and coordinates of the actual prop line are then stored in said computer as coordinates of a further new baseline.

10. The method defined in claim 1 wherein a baseline for a subsequent drawing of said props after said conveyor element is constituted by a line parallel to said actual conveyor line.

11. The method defined in claim 1 wherein sensors of displacement of said displacement cylinders feed values of movement of a walking support constituted by said props to said computer to supply said computer with coordinates of the actual prop line which are stored in the computer to define a new baseline.

12. The method defined in claim 1 wherein for partial mining along said front the actual positions of some of said conveyor elements are corrected by advancing them with defined cutting-depth setpoint values to bring them to the setpoint conveyor line, and actual-value coordinates of the conveyor elements coinciding with the setpoint conveyor line are then stored in said computer as coordinates of a new baseline.

13. The method defined in claim 1 wherein after drawing of the props after the conveyor elements, a difference is formed between a setpoint stroke determined by the computer and the respective actual stroke value, and the respective conveyor element is then advanced by a stroke reduced by the maximum difference.

14. The method defined in claim 1 wherein a difference value is determined between setpoint strokes of said displacement cylinders determined by said computer and respective actual stroke values, and upon repetition of a predetermined magnitude of said difference values for a respective displacement cylinder, a signal is triggered at the respective prop corresponding to the latter displacement cylinder.

* * * * *